US006543845B2

(12) United States Patent
Seitz et al.

(10) Patent No.: US 6,543,845 B2
(45) Date of Patent: Apr. 8, 2003

(54) FURNITURE CONNECTION SYSTEM AND METHOD

(75) Inventors: Robert K. Seitz, Kettering, OH (US); Gregory A. Seitz, Kettering, OH (US); Michael P. Kobes, Oregonia, OH (US); Lee H. Fister, Jr., Centerville, OH (US)

(73) Assignee: August Incorporated, Centerville, OH (US)

( * ) Notice: Subject to any disclaimer, the term of this patent is extended or adjusted under 35 U.S.C. 154(b) by 37 days.

(21) Appl. No.: 09/886,815

(22) Filed: Jun. 21, 2001

(65) Prior Publication Data

US 2002/0195848 A1 Dec. 26, 2002

(51) Int. Cl.[7] ..... A47C 15/00
(52) U.S. Cl. ..... 297/248; 297/463.1; 248/200
(58) Field of Search ..... 297/232, 248, 297/249, 257, 463.1, 463.2; 248/200

(56) References Cited

U.S. PATENT DOCUMENTS

| | | | | |
|---|---|---|---|---|
| 2,451,143 | A | * | 10/1948 | Ammerman |
| 2,996,770 | A | * | 8/1961 | Norman |
| 3,988,034 | A | | 10/1976 | Fister, Jr. |
| D242,885 | S | | 1/1977 | Fister, Jr. |
| 4,232,899 | A | | 11/1980 | Fister, Jr. |
| D275,342 | S | | 9/1984 | Fister, Jr. |
| 4,668,011 | A | | 5/1987 | Fister, Jr. |
| D318,379 | S | | 7/1991 | Fister, Jr. |
| D318,576 | S | | 7/1991 | Fister, Jr. |
| 5,544,938 | A | * | 8/1996 | Saul et al. |
| 5,848,821 | A | * | 12/1998 | Kirby |
| 5,931,529 | A | * | 8/1999 | LaPointe et al. |

FOREIGN PATENT DOCUMENTS

| | | | |
|---|---|---|---|
| GB | 3241179 | * | 5/1984 |
| GB | 2221970 | * | 2/1990 |
| GB | 2269628 | * | 2/1994 |

* cited by examiner

*Primary Examiner*—Laurie K. Cranmer
(74) *Attorney, Agent, or Firm*—Wood, Herron & Evans, LLP

(57) ABSTRACT

A furniture grouping includes a number of individual furniture units that are easily and securely connected together with a connection system. Each furniture unit includes a base to which a connector is attached. The connector includes a face panel to span and conceal gaps and spacings between the furniture units and the connector to provide a substantially flush, continuous and finished juncture between the furniture units. The connector is also easily and conveniently installed for removable connection to the adjacent furniture units.

9 Claims, 3 Drawing Sheets

FURNITURE CONNECTION SYSTEM AND METHOD

BACKGROUND OF THE INVENTION

This invention relates generally to modular furniture and, more particularly, to a system and method for connecting units of furniture together.

Today, in interior design and especially in the composition of furniture arrangement, modular furniture is important both functionally and aesthetically. Commonly, modular furniture includes a variety of furniture units such as armless chairs, arm chairs, armless sofas, armed sofas, benches, tables and the like that can be assembled together in a vast array of combinations into a desired furniture grouping. Furniture units of this type are commercially available from the assignee of this invention and are disclosed in U.S. Pat. Nos. 4,668,011; 4,232,899; and 3,988,034, each of which are hereby incorporated by reference in their entirety.

Furniture of this type allows for space-saving benefits, is highly functional, adapted to numerous types of environments and has an aesthetic quality which harmonizes with the room where it is installed. The individual furniture units combine into a designed furniture grouping that synthesizes the area in an aesthetically pleasing and functional manner. Furniture groupings of this type are commonly found in public areas such as lounges, libraries, shopping malls, airport terminals, waiting areas and the like.

Once a designer has selected the appropriate furniture units, chairs, tables, sofas and the like and then proper arrangement, the selected units must be connected together into a single furniture grouping. This provides the advantages that users cannot readily reconfigure, remove or otherwise dislodge selected units of furniture in the grouping. Furthermore, the individual furniture units, when combined, provide a more aesthetically pleasing and overall functional grouping compared to the individual units.

Furniture units of this type commonly include a base often made of wood extending downwardly from the furniture unit itself to support the furniture unit on the floor. Very often, the perimeter of the base is recessed relative to the footprint of the furniture unit for structural stability and aesthetic purposes. As shown in FIGS. 1 and 1A, one known technique for connecting furniture units 11 of this type together into a furniture grouping 13 is commonly referred to as a plinth base connector system. The plinth base connector system includes a block 15 which is positioned in a spacing 17 between the bases 19 of adjacent furniture units 11. The block 15 is positioned to form a recess 21 relative to a common face of the bases of the furniture units 11. Moreover, a gap G is commonly realized between an edge 25 of the block 15 and the adjacent base 19 of the respective furniture unit 11. As such, the plinth base connector does not provide a continuous or flush connection or juncture of the furniture units 11.

Moreover, the block 15 is mounted to the furniture units 11 through a generally T-shaped connector plate 27. A distal end of a stem 29 of the T-shaped plate 27 is screwed or otherwise mechanically mounted to an upper edge of the block 15. Each arm 31 of the T-shaped plate 27 includes an oval slot 33 through which a bolt 35 or other mechanical fastener projecting from the furniture unit 11 may be inserted. A nut 37 or the like is then threaded onto the bolt 35 to secure the connector plate 27 and connector block 15 between the furniture units 11.

Commonly, the bolts 35 to which the connector plate 27 is mounted to the furniture units 11 project from the furniture units 11 themselves and are commonly seated within plywood or other similar components of the furniture. Likewise, the bolts 35 project vertically downward from the furniture units 11. As such, it is difficult for an installer to conveniently and easily access the bolts 35 because the installer must reach up under the furniture unit 11 to accurately locate the bolts 35 and position the connector plate 27 on the bolts 35.

Moreover, the bolts 35 are often not securely seated in the furniture and could become dislodged, pulled, twisted or ripped from the furniture when the furniture grouping 13 is jarred, dislodged or moved. The recess 21 not only provides an aesthetically unattractive appearance to the furniture unit, but also provides an area for dirt or other debris that cannot be easily accessed by a vacuum cleaner or sweeper.

Therefore, it is apparent that there is a need for an improved connection system and associated method for joining individual furniture units together into a furniture grouping that is both aesthetically pleasing, secure and easily accomplished.

SUMMARY OF THE INVENTION

These and other objectives of the invention have been attained by an improved furniture connection system and associated method for joining furniture units into a furniture grouping. The invention is primarily intended for joining various chairs, chair segments, corner sections, benches, tables and the like together into a furniture grouping. Each unit of furniture in the grouping has a base which preferably includes one or more sockets on the base. The respective sockets of adjacent furniture units are aligned with respect to each other along a face of the furniture grouping. A spacing between the respective bases of the furniture units is filled by a connecter that is removably mounted directly to the bases of the furniture units to join them together. The connector is seated within the sockets of the adjacent furniture unit bases and includes a face panel. The face panel extends outwardly from opposite edges of the connector and onto one of the respective bases. A gap may be provided between each edge of the connector and the adjacent base and the face panel on the connector spans such gaps to define a substantially flush juncture of the bases of the furniture units. Moreover, the connector is not recessed relative to the bases in that it provides a flush juncture. Preferably, the face panel on the connector is a thermoplastic or similar material that resists scuffing and gouging to offer an aesthetically pleasing surface at the flush juncture between the bases of the adjacent furniture units.

The connector is mounted directly to the bases as opposed to the furniture units themselves to thereby provide a more robust and secure connection system. Advantageously, bolts or other mechanical fasteners are preferably inserted through the face of the connector and directly into the base thereby providing more convenient access for the installation of the connector compared to the prior art plinth system.

Another feature of this invention is an insert which likewise includes a face panel. The insert can be removably mounted into the socket at the terminal or end corner of the base when it will not be connected to the adjacent furniture unit. As such, the insert and associated face panel provides a substantially smooth and continuous appearance to the base that can be easily mounted thereto when an adjacent furniture unit is not required.

Another feature on the method of connecting individual furniture units into a furniture grouping according to this invention is utilizing a tool to pull or draw the adjacent furniture units together into proper position and orientation for coupling them together with the connector. In one presently preferred embodiment, the tool has an elongate main body with a hook on one end and a sloped or tapered arm on an opposite end. The hook is positioned around a foot or other portion of the base of one furniture unit and the tool is pivoted about the foot until the tapered arm engages a foot or other portion of the base on a second furniture unit. Continued rotation of the tool draws the furniture units together into proper position for installation of the connector.

Therefore, as a result of this invention, an improved connection system and associated method are provided for joining individual furniture units together into a furniture grouping while providing an aesthetically pleasing flush juncture between the bases of the furniture units and other associated advantages described herein with respect to the invention.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
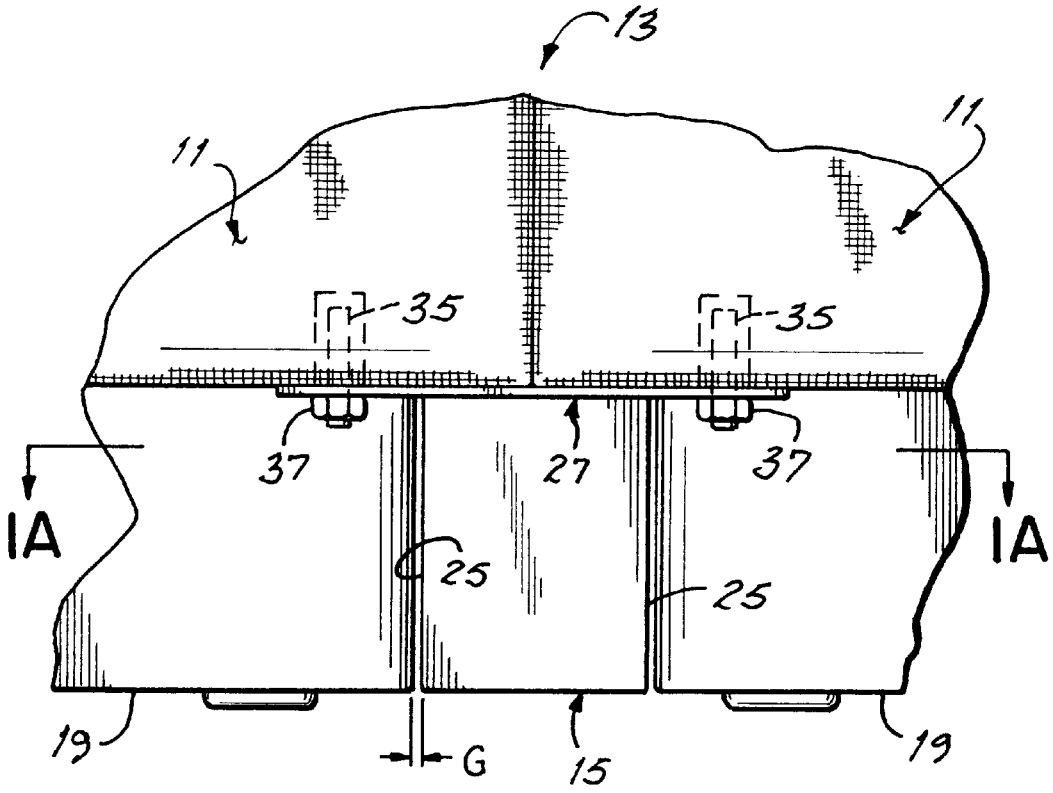
PRIOR ART FIG. 1
FIG. 1 is a front elevational view of a prior art system for connecting adjacent furniture units together.
Figure 1A:
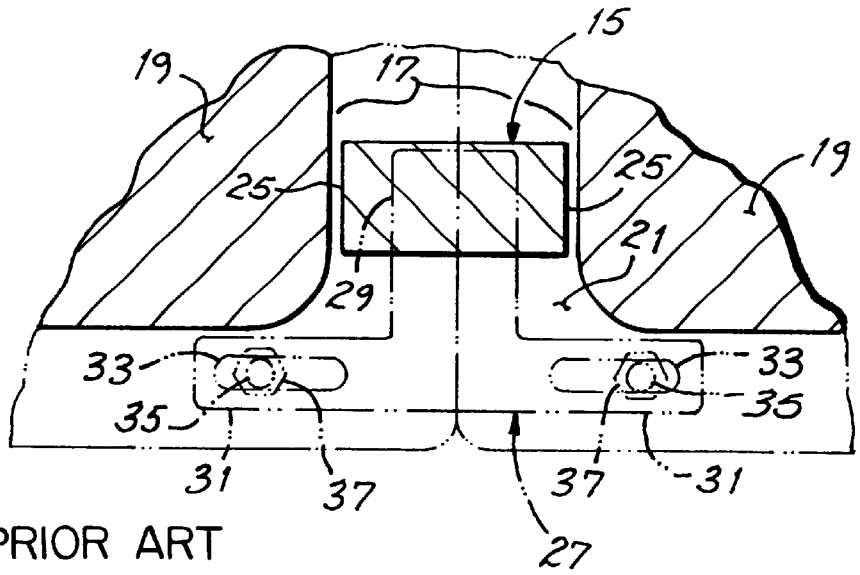
PRIOR ART FIG. 1A
FIG. 1A is a cross-sectional view taken along line 1A—1A of FIG. 1 of the prior art connection system.
Figure 2:
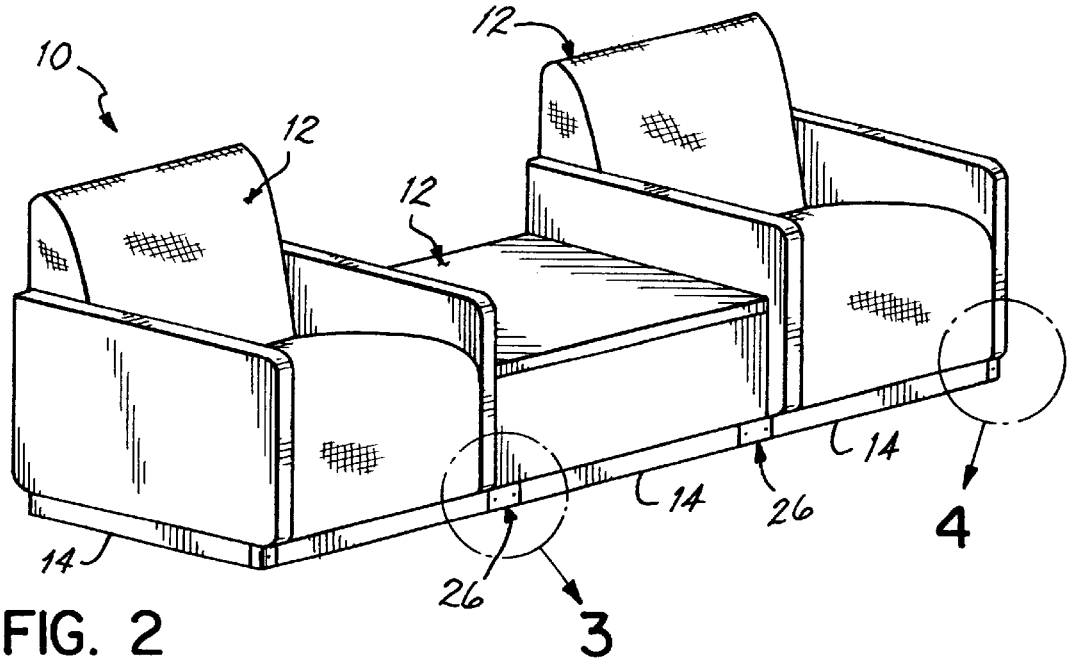
FIG. 2 is a perspective view of multiple furniture units joined together into a furniture grouping according to one embodiment of this invention.

Referring to FIG. 2, a furniture grouping 10 according to one embodiment of this invention is shown in which multiple furniture units 12 are joined together by a furniture connection system and associated method of this invention. Specifically, as shown in FIG. 2, a table is connected to a pair of armchairs to form the furniture grouping 10. However, while armchairs and a table are shown in FIG. 2, it should be readily understood that this invention is applicable for numerous other types of furniture units 12 including, without limitation, armless chairs, armless sofas, armed sofas, corner sections, benches, chair segments, tables and other furniture units 12 of any size, shape, style, design or configuration.

Figure 3A:
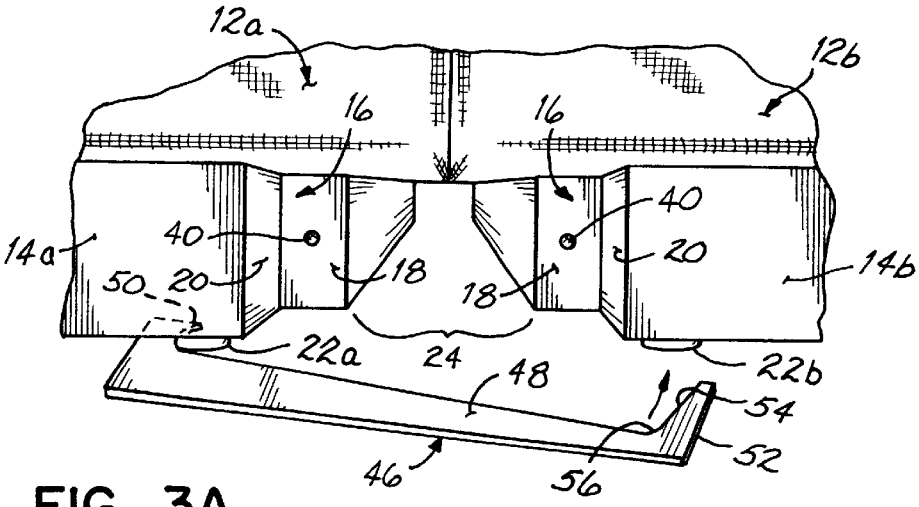
FIGS. 3A–3B are sequential perspective views of encircled area 3 in FIG. 2 of a method for positioning the furniture units with respect to each other and installing a connector to join the bases of the furniture units together.
Figure 3B:
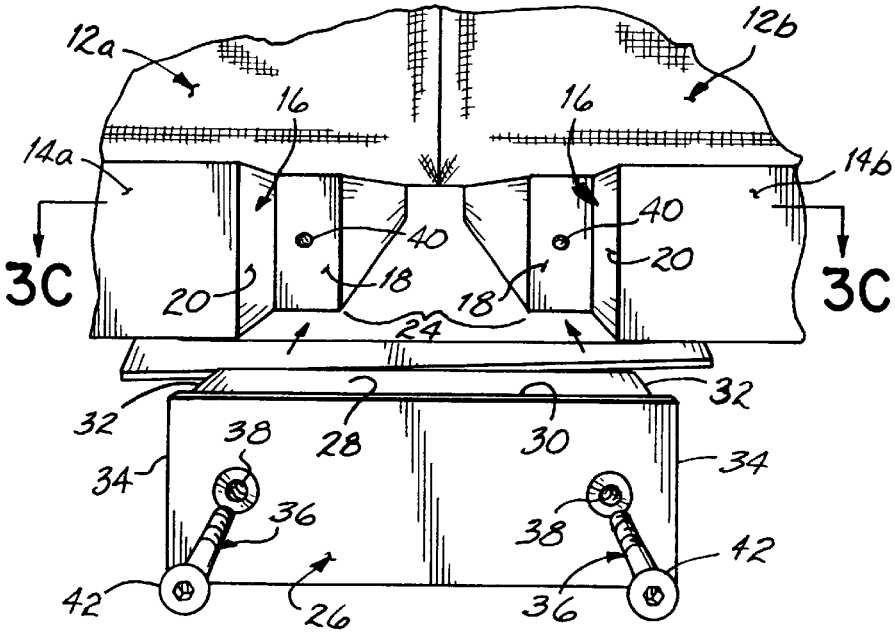

Referring to FIGS. 2 and 3A–3C, each of the furniture units 12 includes a base 14 upon which the furniture unit 12 is supported on the floor. Preferably, the base 14 is constructed of hardwood such as maple or other appropriate material. The base 14 may have a generally rectangular or even square configuration and include a socket 16 at each corner thereof. In one embodiment, each socket has a generally right angle configuration and includes confronting and adjacent faces 18, 20. The base 14 may include appropriate floor-engaging feet 22 or similar structure as is well known by those of skill in this art. Typically, at least one foot 22 is located proximate the socket 16 on a bottom surface of the base 14 as shown in FIG. 3A.

Figure 3C:
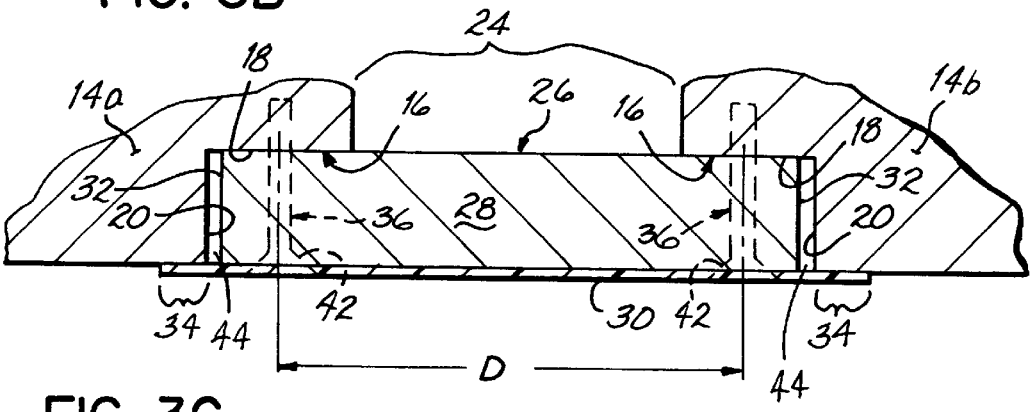
FIG. 3C is a cross-sectional view taken along line 3C—3C of FIG. 3B showing the connector installed on the adjacent furniture units.

When two adjacent furniture units 12 are juxtaposed together as shown in FIGS. 2–3C, a spacing 24 is formed between the bases 14 of the adjacent furniture units 12. The adjacent furniture units 12 are coupled together by a connector 26 which, in one embodiment of this invention, includes a generally rectangular portion 28 and a face panel 30. The connector 26 includes spaced edges 32 on lateral ends of the rectangular portion 28 and the face panel 30 substantially covers a front face thereof and includes extensions 34 which extend beyond the respective spaced edges 32. The connector 26 is adapted to be inserted between aligned adjacent portions of the respective bases 14 of the adjacent furniture units 12 and received within the aligned sockets 16 of the adjacent furniture units 12 as shown in FIG. 3C. When the connector 26 is positioned in the adjacent sockets 16, mechanical fasteners 36 such as screws can be inserted through respective holes 38 in the connector 26 and into receiving holes 40 in the confronting face 18 of the socket 16 of each furniture unit 12. Preferably, a head 42 of the screw 36 is recessed on the face panel 30 of the connector 26 as shown in FIG. 3C.

Furthermore, the back face of the connector 26 is in face-to-face contact with the confronting faces 18 of the sockets 16 on the bases 14. However, the side edges 32 of the connector 26 are spaced by a gap 44 with respect to the respective adjacent faces 20 of the socket 16. The size of the gap 44 may vary from those shown in FIG. 3C; nevertheless, the gaps 44 provide significant advantages for the convenient connection of the furniture units 12 because the precise position of the furniture units 12 relative to one another and the manufacturing tolerances with respect to the position of the receiving holes 40, the size of the connector 26, and the dimensions of the socket 16 and related features are accounted for. Importantly, these aspects of the connection system allow for variations in these dimensions while still providing a generally flush or continuous juncture of the bases 14 of the furniture units 12.

Specifically, the extensions 34 of the connector 26 span the gaps 44 between the edges 32 and adjacent faces 20 of the sockets 16 so that at least a portion of each extension 34 is juxtaposed to the base 14 as shown in FIG. 3C. Therefore, a substantially flush and continuous connection is provided at the juncture of the bases 14 to provide a smooth and aesthetically pleasing continuous look while avoiding the recess of the prior art plinth connector and the associated disadvantages of the recess.

In one embodiment, the face panel 30 of the connector 26 is a different material than the rectangular portion 28 and is preferably a thermoplastic material, more preferably an acrylic/PVC alloy and most preferably Kydex®. Kydex® is commercially available from a number of sources including Laird Plastics (www.laird-plastics.com). Kydex® is a thermoplastic sheet that can be laminated to a wood rectangular portion 28 using commercially available adhesives or by hot pressing or cold pressing methods. As a result, the face panel 30 is a protective surface which resists impact, gouging and general abuse. Additionally, the face panel 30 does not chip, crack, break or snap so that the extensions 34 on the connector 26 will prove to be durable and effective to provide a secure connection system and a substantially continuous or generally flush juncture. While one configuration of the connector 26 is shown and described herein, various other configurations, shapes, designs and styles can be utilized according to this invention.

The method of connecting the adjacent furniture units 12 begins with juxtaposing the first and second furniture units 12 together which in one embodiment utilizes a tool 46 as shown in FIG. 3A. The tool 46 includes an elongate body 48 having a hook 50 on one end. The hook 50 is adapted to engage or hook onto the foot 22*a* of one of the furniture units 12*a*. The tool 46 is then pivoted toward the base 14*b* of the second furniture unit 12*b* so that an arm 52 on the opposite end of the tool 46 engages the foot 22*b* on the second furniture unit 12*b*. The arm 52 includes a sloped or tapered surface 54 that engages the foot 22*b* so that continued pivotal movement of the tool 46 with the hook 50 engaged on the foot 22*b* of the first furniture unit 12*a* will draw the furniture units 12*a*, 12*b* together until the foot 22*b* on the second furniture unit 12*b* is seated within an elbow 56 of the tool 46. At this time, the bases 14*a*, 14*b* and sockets 16*a*, 16*b* of the adjacent furniture units 12*a*, 12*b* will be aligned and positioned relative to one another and a separation distance D between the receiving holes 40 in the respective bases 14 will correspond with the separation distance D between the holes 38 in the connector 26 so that the fasteners 36 can be conveniently and easily inserted generally horizontally through the respective holes 38, 40 for coupling the adjacent furniture units 12 together.

Because the connector 26 according to this invention is coupled directly to the bases 14 of the adjacent furniture units 12, a more secure and robust connection is provided in that the connector 26 is coupled directly to a part of the furniture unit that is typically hardwood such as maple. Prior art furniture connection systems were joined to the furniture unit 12 and not the base 14 and provided a higher likelihood that the connection would be pulled or dislodged during movement or jostling of the furniture grouping because the connection was typically into plywood or other less robust materials compared to the hardwood or maple base of the furniture unit.

Figure 4:
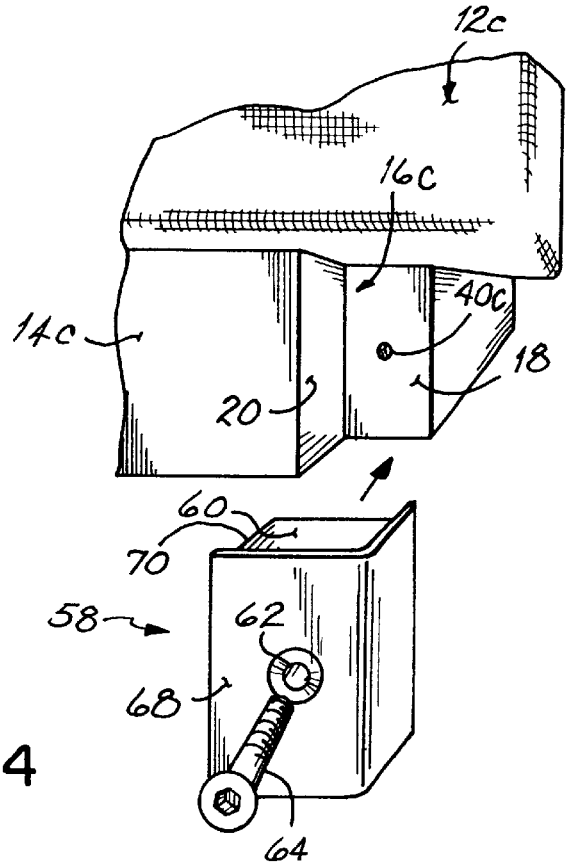
FIG. 4 is a perspective view of encircled area 4 of FIG. 2 showing an insert being mounted into a socket in a furniture unit base to provide a substantially continuous finished surface to the base.

An additional feature of this invention is shown in FIG. 4 in which an exposed socket 16*c* on the end furniture unit 12*c* of the furniture grouping 10 is finished with an insert 58. Each of the bases 14 of the furniture units 12 according to this invention includes sockets 16 for convenient and flexible arrangement of the furniture units 12 within the grouping 10. Nevertheless, the sockets 16*c* on the end furniture units 12*c* are not required for connecting to other furniture units 12. Therefore, the insert 58 is removably mounted in the end socket 16*c* to provide a substantially continuous face on the base 14*c* of the furniture unit 12*c* and a finished appearance to the grouping 10.

In one embodiment, the insert 58 includes a generally rectangular or square block 60 with a throughhole 62 therein. The block 60 is adapted to be inserted into the socket 16*c* with a fastener 64 inserted through the throughhole 62 and into a receiving hole 40*c* in the base 14*c*. The insert 58 also includes a face panel 68 of a similar material to that for the connector 26. With respect to the insert 58, the face panel 68 extends beyond diagonally opposed edges 70 of the insert 58 to overlap onto the adjacent portions of the base 14*c* as shown in FIG. 4. The insert extensions 66 extend beyond the edges 70 and onto the base 14*c* to conceal the socket 16*c* and define a substantially continuous and finished portion of the face of the base 14*c* of the furniture unit 12*c*.

As a result of this invention, a convenient and secure connection system and associated method is provided for joining furniture units together with an aesthetically pleasing substantially flush juncture along the bases of the respective furniture units.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A furniture grouping comprising:

a first furniture unit having a first base;

a second furniture unit having a second base and being juxtaposed to the first furniture unit;

a spacing between the respective bases of the first and second furniture units;

a connector coupled to the first and second furniture units joining the furniture units together, the connector having spaced edges;

wherein at least a portion of the connector is positioned in the spacing between the bases of the first and second furniture units;

at least one extension of the connector extending beyond one of the edges of the connector and onto one of the bases;

wherein the connector and the at least one extension cooperate to define a substantially flush juncture of the bases of the furniture units;

a socket in one of the bases providing a discontinuous portion of a face of the base;

the connector being removably mounted in the socket; and a face panel on the connector;

wherein the face panel and the extension cooperate to conceal the socket and define a substantially continuous portion of the face on the base of the furniture unit.

2. The furniture grouping of claim 1 wherein each of the bases has one of the sockets and the respective sockets are aligned with respect to each other and the connector is positioned in the sockets of the bases.

3. The furniture grouping of claim 2 wherein the sockets are each located at a corner of the respective furniture unit bases.

4. The furniture grouping of claim 1 further comprising:

a second extension of the connector;

wherein the extensions each extend beyond one of the edges of the connector.

5. The furniture grouping of claim 1 further comprising:

a gap between the one of the edges of the connector and an adjacent portion of the one of the bases;

wherein the extension spans the gap to define the substantially flush juncture of the bases of the furniture units.

6. The furniture grouping of claim 1 wherein the connector is removably attached to the bases of each of the furniture units, the furniture grouping further comprising:

a plurality of fasteners attaching the connector to the bases.

7. The furniture grouping of claim 1 wherein the face panel is integral with the extension and generally planar.

8. The furniture grouping of claim 7 wherein the face panel is of a dissimilar material relative to the connector.

9. A furniture unit comprising:

a base;

a socket in the base, wherein the socket is located at a corner of the base;

an insert removably mounted in the socket and having at least one edge;

a face panel on the insert;

an extension of the face panel extending beyond the edge of the insert and onto the base;

wherein the face panel and the extension cooperate to conceal the socket and define a substantially continuous face on the base of the furniture unit; and a second edge of the insert spaced from the at least one edge;

a second extension of the face panel extending beyond the second edge of the insert and onto the base;

wherein the extensions are non-parallel with respect to each other.

* * * * *